US006648753B1

(12) United States Patent
Tracy et al.

(10) Patent No.: US 6,648,753 B1
(45) **Date of Patent: *Nov. 18, 2003**

(54) METHOD OF PLAYING A GROUP PARTICIPATION GAME

(75) Inventors: Joseph J. Tracy, Westminster, MD (US); Mark Guthrie Meyer, Phoenix, MD (US)

(73) Assignee: IGT, Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/106,659

(22) Filed: Jun. 29, 1998

(51) Int. Cl.[7] ..... A63F 1/00

(52) U.S. Cl. ..... 463/16; 463/17; 463/18; 463/19; 463/20; 463/21; 463/22; 273/143 R

(58) Field of Search ..... 463/16–22, 25–28; 273/269, 274, 139, 138.1, 138.2, 143 R, 454, 460

(56) References Cited

U.S. PATENT DOCUMENTS

| | | | | |
|---|---|---|---|---|
| 4,805,907 A | | 2/1989 | Hagiwara | 273/138 A |
| 4,998,199 A | | 3/1991 | Tashiro et al. | 364/410 |
| 5,112,050 A | * | 5/1992 | Koza et al. | 273/139 |
| 5,116,049 A | | 5/1992 | Sludikoff et al. | 273/139 |
| 5,186,463 A | | 2/1993 | Marin et al. | 273/138 R |
| 5,232,221 A | | 8/1993 | Sludikoff et al. | 273/139 |
| 5,259,616 A | | 11/1993 | Bergmann | 273/138 A |
| 5,273,281 A | | 12/1993 | Lovell | 273/138 R |
| 5,332,219 A | | 7/1994 | Marnell, II et al. | 273/138 A |
| 5,342,049 A | | 8/1994 | Wichinsky et al. | 273/119 R |

(List continued on next page.)

FOREIGN PATENT DOCUMENTS

| | | |
|---|---|---|
| AU | 18428/92 | 12/1992 |
| AU | 21070/92 | 10/1993 |
| AU | 52499/96 | 2/1997 |
| AU | 199716432 B2 | 9/1997 |
| AU | 50327/96 | 10/1997 |
| AU | 45403/97 | 6/1998 |
| AU | 63553/98 | 10/1998 |

(List continued on next page.)

OTHER PUBLICATIONS

Website entitled "Oregon Lottery Megabucks–How to play" last updated on Jul. 31, 2000 located at http://www.oregon-lottery.org/mega/mhowto.htm.

*Primary Examiner*—Valencia Martin-Wallace
*Assistant Examiner*—Carmen D. White
(74) *Attorney, Agent, or Firm*—Marshall, Gerstein & Borun LLP

(57) ABSTRACT

A group wagering game is provided in which all entrants win or lose simultaneously as a group. The method of playing the game includes forming a group consisting of all entrants who have made a wager on the outcome of the game, and determining whether the group is a winner. The game can either be played as a stand alone game, or in combination with an individual participation game. When combined with another game, the method includes forming a group of at least some of the entrants in the individual participation game, e.g. all winners, who have made a wager on the outcome of the group participation game. As such, a "bonus" round of play is provided which generates group interest and excitement in the gaming experience.

15 Claims, 2 Drawing Sheets

U.S. PATENT DOCUMENTS

| | | | | | |
|---|---|---|---|---|---|
| 5,380,007 | A | | 1/1995 | Travis et al. | 273/138 A |
| 5,393,057 | A | * | 2/1995 | Marnell, II | 273/85 |
| 5,401,024 | A | | 3/1995 | Simunek | 273/138 A |
| 5,451,052 | A | | 9/1995 | Behm et al. | 273/139 |
| 5,456,465 | A | | 10/1995 | Durham | 273/138 A |
| 5,486,005 | A | | 1/1996 | Neal | 273/292 |
| 5,513,846 | A | | 5/1996 | Niederlein et al. | 273/143 R |
| 5,540,442 | A | | 7/1996 | Orselli et al. | 463/17 |
| 5,564,700 | A | * | 10/1996 | Celona | 463/27 |
| 5,655,961 | A | | 8/1997 | Acres et al. | 463/27 |
| 5,722,891 | A | | 3/1998 | Inoue | 463/20 |
| 5,732,948 | A | | 3/1998 | Yoseloff | 273/274 |
| 5,741,183 | A | | 4/1998 | Acres et al. | 463/42 |
| 5,743,800 | A | | 4/1998 | Huard et al. | 463/26 |
| 5,752,882 | A | | 5/1998 | Acres et al. | 463/42 |
| 5,770,533 | A | * | 6/1998 | Franchi | 463/42 |
| 5,772,509 | A | * | 6/1998 | Weiss | 463/16 |
| RE35,864 | E | * | 7/1998 | Weingardt | 463/28 |
| 5,820,459 | A | | 10/1998 | Acres et al. | 463/25 |
| 5,823,874 | A | | 10/1998 | Adams | 463/17 |
| 5,830,063 | A | * | 11/1998 | Byrne | 463/18 |
| 5,833,537 | A | | 11/1998 | Barrie | 463/21 |
| 5,836,817 | A | | 11/1998 | Acres et al. | 463/26 |
| 5,848,932 | A | | 12/1998 | Adams | 463/20 |
| 5,876,284 | A | | 3/1999 | Acres et al. | 463/25 |
| 5,882,261 | A | | 3/1999 | Adams | 463/20 |
| 5,911,418 | A | | 6/1999 | Adams | 273/274 |
| 5,996,997 | A | | 12/1999 | Kamille | 273/139 |
| 6,004,207 | A | | 12/1999 | Wilson, Jr. et al. | 463/20 |
| 6,012,982 | A | | 1/2000 | Piechowiak et al. | 463/16 |
| 6,077,162 | A | * | 6/2000 | Weiss | 463/26 |
| 6,089,978 | A | | 7/2000 | Adams | 463/20 |
| 6,142,872 | A | * | 11/2000 | Walker et al. | 463/16 |
| 6,149,521 | A | | 11/2000 | Sanduski | 463/13 |
| 6,179,710 | B1 | | 1/2001 | Sawyer et al. | 463/16 |
| 6,217,448 | B1 | | 4/2001 | Olsen | 463/25 |
| 6,227,969 | B1 | | 5/2001 | Yoseloff | 463/13 |
| 6,238,288 | B1 | | 5/2001 | Walker et al. | 463/26 |
| 6,309,300 | B1 | | 10/2001 | Glavich | 463/26 |
| 6,334,814 | B1 | | 1/2002 | Adams | 463/20 |
| 6,340,158 | B2 | | 1/2002 | Pierce et al. | 273/138.1 |
| 6,375,568 | B1 | | 4/2002 | Roffman et al. | 463/26 |
| 6,419,579 | B1 | | 7/2002 | Bennett | 463/20 |

FOREIGN PATENT DOCUMENTS

| | | | |
|---|---|---|---|
| DE | 30 35 898 | A1 | 4/1982 |
| DE | 30 35 947 | A1 | 5/1982 |
| DE | 29 38 307 | C2 | 6/1982 |
| DE | 34 15 114 | A1 | 10/1985 |
| DE | 29 38 307 | C3 | 7/1987 |
| DE | 38 22 636 | A1 | 1/1990 |
| DE | 197 06 286 | A1 | 5/1998 |
| DE | 298 03 107 | U1 | 9/1998 |
| DE | 298 16 453 | U1 | 4/1999 |
| DE | 197 51 746 | A1 | 5/1999 |
| EP | 0 798 676 | A1 | 10/1997 |
| EP | 0 874 337 | A1 | 10/1998 |
| EP | 0 896 304 | A2 | 2/1999 |
| EP | 0 919 965 | A2 | 6/1999 |
| ES | 529535 | | 6/1983 |
| ES | 529536 | | 6/1983 |
| ES | 2 006 400 | | 4/1989 |
| ES | 2 006 401 | | 4/1999 |
| GB | 2 230 373 | A | 10/1990 |
| GB | 2 222 712 | B | 6/1992 |
| GB | 2 295 775 | A | 6/1996 |
| GB | 2 328 311 | A | 2/1999 |
| WO | WO 91/17529 | | 11/1991 |
| WO | WO 98/40138 | | 9/1998 |

* cited by examiner

METHOD OF PLAYING A GROUP PARTICIPATION GAME

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

This invention relates generally to games of chance, and more particularly to a method of playing a group wagering game in which all entrants win or lose simultaneously as a group.

In known wagering games, each individual entrant places a wager on the outcome of an event such as a roll of dice, a selection of one or more randomly generated indicia such as cards or numbers, a horse or dog race, a Jai Alai game, a sporting event, or the like, and the wager is won or lost depending on the outcome of the event. Typically, entrants are able to place their wagers on one or more of several possible outcomes of an event such that the actual outcome creates both winners and losers among the group of entrants of a particular game.

Some wagering games are designed around a particular apparatus such that the entrants must seek out a gaming table or machine in order to play. Other games can be played anywhere people are gathered and wagering is available. Regardless of the game being played or the venue in which it is presented for wagering, there is a need for a gaming method that will attract new entrants to wagering games and hold the attention of existing entrants so that such games remain attractive relative to the many new games and diversions constantly being developed.

BRIEF SUMMARY OF THE INVENTION

In one aspect, the invention is directed to a method of playing a group participation wagering game having a minimum wager amount in which the method may comprise facilitating the forming of a group of a plurality of entrants, wherein each of the entrants participates in the group participation game irrespective of the entrant's participation in an individual participation game, and wherein each of the entrants is an individual who has wagered at least the minimum wager amount. The amount each entrant wagered may be made on a single outcome of a single group participation game, and each outcome of said group participation game may be independent of an outcome of the individual participation game. The method may further comprise determining the outcome of the single group participation game based on a single set of indicia common to the group, wherein all entrants in the group collectively win or collectively lose the single group participation game based on the single set of indicia.

In another aspect, the invention is directed to a method of playing a group participation wagering game having a minimum wager amount in which the method may comprise enabling entrants to participate in the group participation game irrespective of the entrants' participation in an individual participation game, wherein each of the entrants is an individual who has wagered at least the minimum wager amount. The amount each entrant wagered may be made on a single outcome of a single group participation game, and each outcome of the group participation game may be independent of an outcome of the individual participation game. The method may further comprise determining the outcome of the single group participation game based on a single set of indicia common to the group wherein all entrants in the group collectively win or collectively lose the single group participation game based on the single set of indicia.

Other aspects of the invention are defined by the claims set forth at the end of this patent.

It is an object of the present invention to provide a simple wagering game that can be used in combination with existing games to generate and sustain player interest by offering a socially exhilarating group win environment around the game.

It is another object of the present invention to provide a wagering game that can be used as a stand alone game in which all entrants win or lose simultaneously as a group rather than as individuals, again providing group excitement.

In accordance with these and other objects evident from the following description of a preferred embodiment of the invention, a method of playing a group participation wagering game is provided, wherein the game includes the principle steps of forming a group consisting of all entrants who have made a wager on the outcome of the game, determining whether the group as a whole is a winner, and indicating the outcome of the game. Preferably, each entrant is able to make a wager that differs in size from the wagers being made by the other entrants, and the size of the winnings awarded to each entrant corresponds to the size of the entrant's wager. However, regardless of the amount of the wager placed by any entrant, all entrants in the group game win or lose together depending on the outcome of the game.

In accordance with a particular embodiment of the present invention, the step of determining whether the group is a winner includes randomly generating indicia in an array and comparing at least a portion of the array with one or more predetermined winning combinations of indicia. As such, the entire group can watch the display of such indicia one-by-one, anticipating a win or loss and celebrating or mourning collectively. This social event adds to the enjoyment of the game and draws others to learn about the game and become entrants.

When used in combination with an individual participation game such as keno, bingo, slot machines, card games, dice games, sporting events and the like, the method of the present invention includes the steps of forming a group of at least some of the entrants in the first game, e.g. all winners, who made a wager on the outcome of the group participation game, determining whether the entire group is a winner of the group game, and indicating the outcome of the group game. Again, use of the group game increases the enjoyment of the gaming entrants and draws new players to the games.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
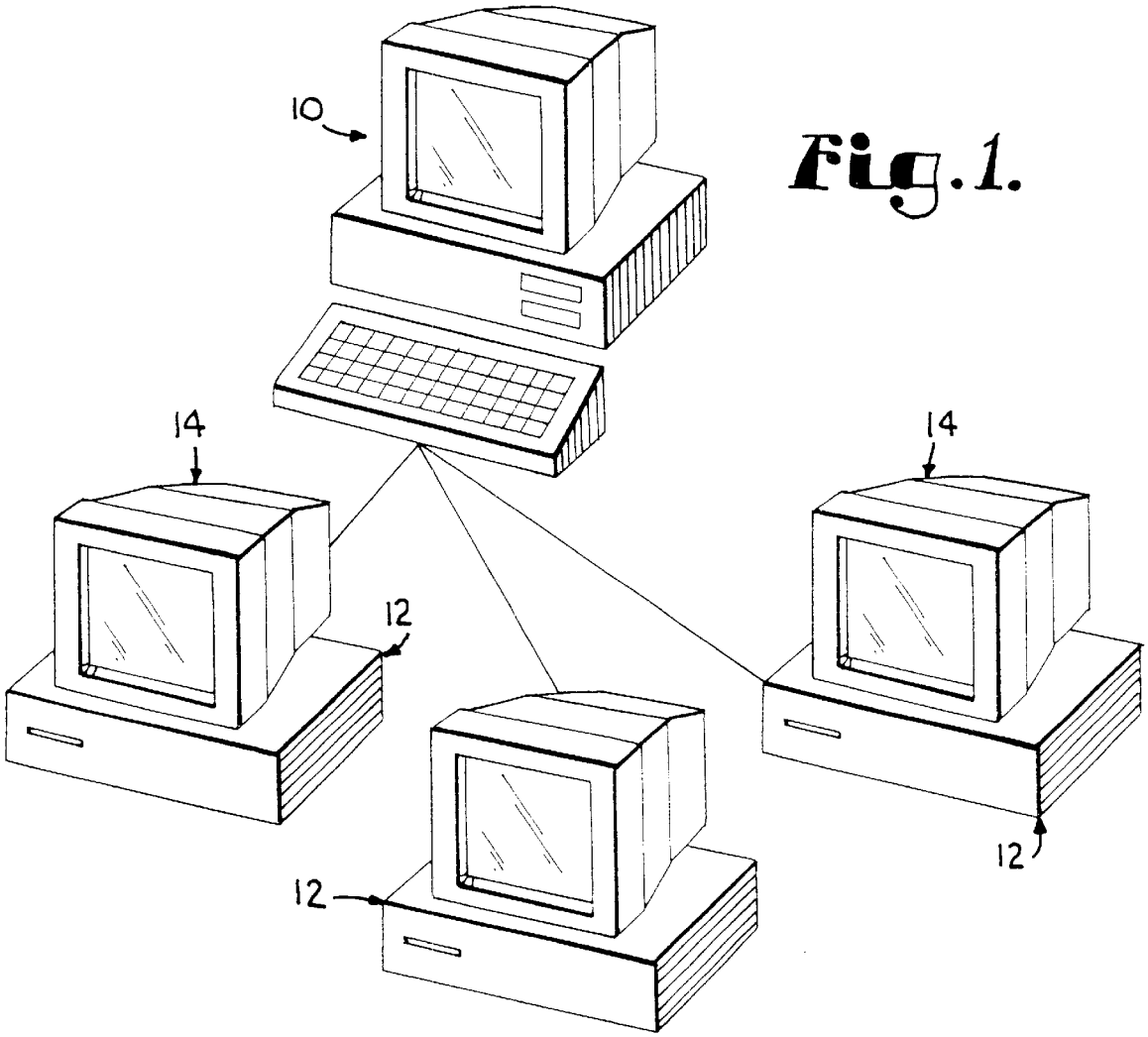
FIG. 1 is a schematic view of an apparatus for use in hosting a group wagering game in accordance with the preferred embodiment.

An apparatus capable of being used in hosting a group participation game in accordance with the preferred embodiment of the present invention is illustrated in FIG. 1, and includes a central processing unit 10 for generating random numbers or other indicia and transmitting the generated indicia to plural remote receivers 12, and a monitor or display 14 associated with each receiver for displaying the indicia and providing an indication of the outcome of the game. In addition, the receiver may form a part of a processing unit, such as a conventional interactive compact disk player or the like, for driving the display 14 so that entrants can observe the game in progress and witness the outcome thereof from various remote sites such as restaurants, taverns and gathering spots. Preferably, the central processing unit 10 includes software for generating the random numbers or indicia and for encoding the generated indicia for transmission to the various receivers, and the remote receivers associated with the displays include software for decoding the transmission and for driving the displays.

It is understood that the apparatus shown in FIG. 1 is provided for illustrative purposes only, and that the game of the present invention need not be hosted using any particular apparatus but may instead be carried out by any suitable electronic, mechanical or manual device as would be evident by a reading of the following description. For example, it is possible to employ a number generator in the form of a conventional blower-type apparatus adapted for use with ping pong balls, on which indicia are printed, for randomly generating the indicia, and a manual or mechanical display can be used at one or more locations to display the drawn indicia so that the group of entrants can monitor the progress of the game and determine whether the group is a winner or a loser. As such, the apparatus shown and described does not in any way limit the scope of the present invention, but merely represents one mode for carrying out the game.

Figure 2:
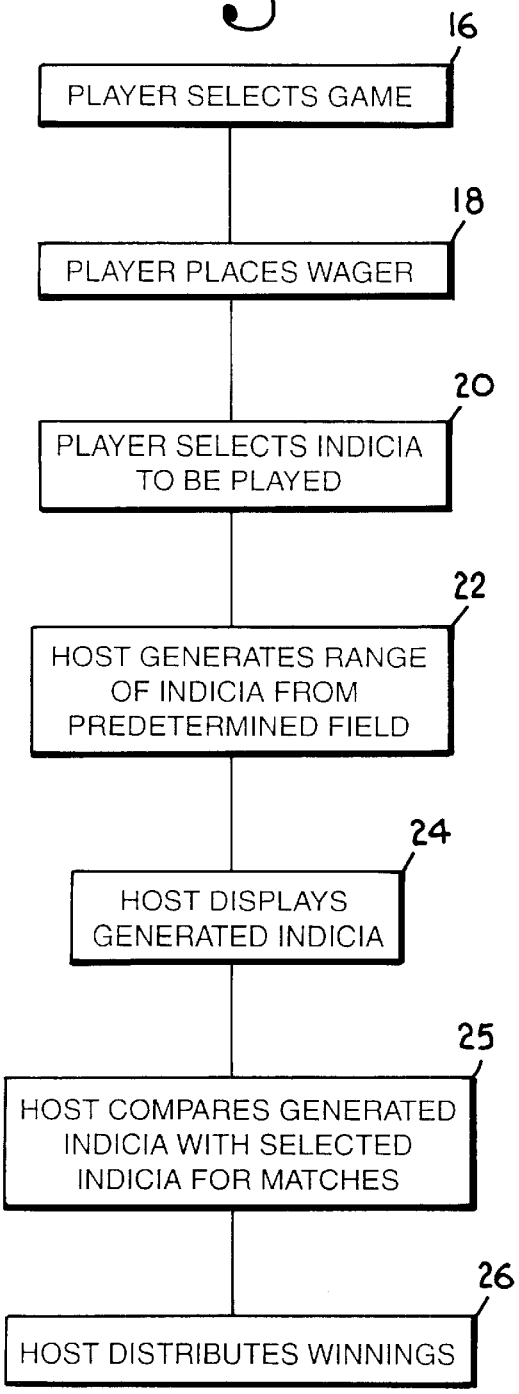
FIG. 2 is a flow chart of a method of playing a keno game to be used in combination with the group participation game of the preferred embodiment.

In accordance with a first embodiment of the preferred game, the group game is combined with an individual participation keno game. As shown in FIG. 2, the keno game is played by allowing entrants at 16 to select the number of "spots" to be played in a given game of keno, and at 18 to place a wager on the outcome of a random drawing of a predetermined range of indicia or numbers out of a large field, e.g. a drawing of 20 indicia out of a field of 80. If desired, an option may be provided whereby the entrant can allow the host to select his indicia automatically. At 20, the player selects the particular indicia or numbers to be played, and at 22 the central processing unit randomly draws the range of indicia from the field, and these indicia are encoded and transmitted to the various remote receivers where they are decoded and displayed, as at step 24. The individual entrants are thus able to watch as the generated range of indicia are displayed so that they can monitor their individual results and determine whether they are a winner or loser in the game. If they are a winner, they turn in their game card, which they filled out when placing their wager, and the indicia they selected are compared with the range for matches at 25.

If at least some of the numbers selected by the entrant are among the numbers in the range drawn from the field, the entrant wins a reward at 26. For example, a the reward for selecting a single indicia that matches one of the 20 indicia drawn from a field of 80 might be $2, whereas the reward for selecting 10 indicia that match 10 of the 20 indicia drawn from the same field might be $100,000. If all of the numbers selected by the entrant are not among the range drawn from the field, a smaller percentage of correct selections wins. Thus, if an entrant selected 10 indicia and 5 of them match indicia drawn from the field, a prize of $2 might be rewarded.

Figure 3:
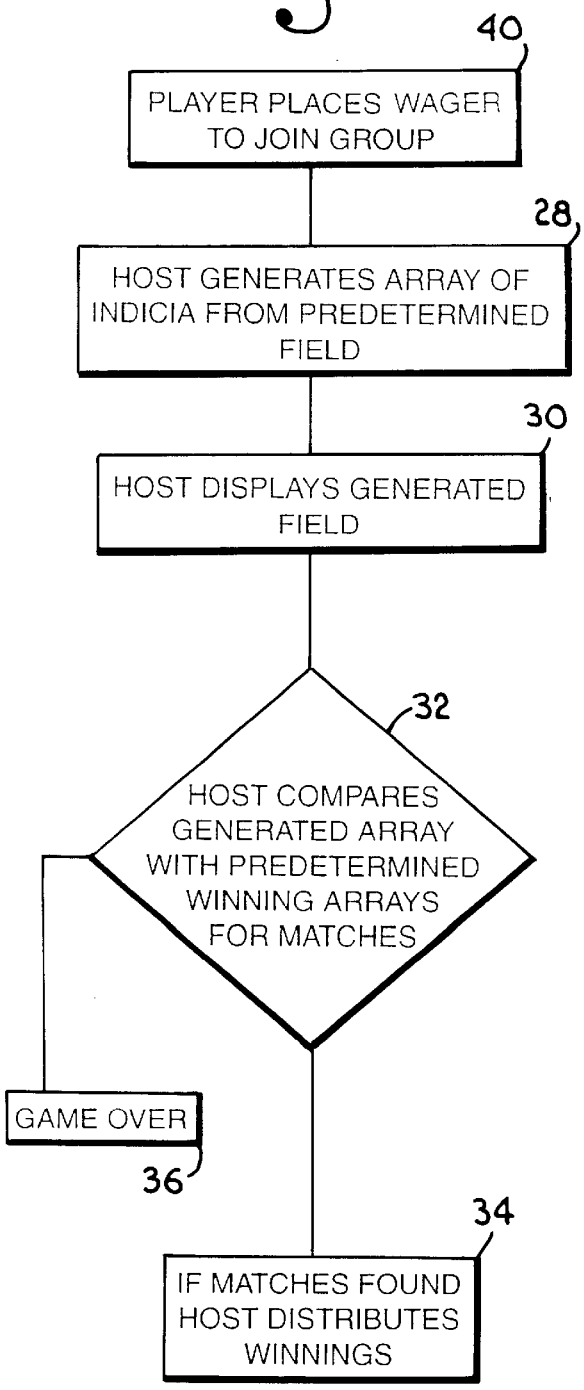
FIG. 3 is a flow chart of the method of the preferred group participation game.

The keno game is combined with the group game of the present invention by allowing an individual to enter the group participation game at the same time he or she enters the keno game. For example, at 16, each entrant is given the opportunity not only to enter the keno game, but also to enter the group participation game, and at 18, an entry fee is paid for each of the games entered. Entrants are not required or allowed to make any selection or prediction of a particular winning combination, and all entrants have the identical odds of winning the game. If the group game is selected and a wager made, then after the keno game is over, the group game is played. With reference to FIG. 3, at 28, the same unit 10 used to play the keno game can be used to randomly generate indicia in a predetermined array that is transmitted to the various receivers and displayed at 30. If a comparison of the generated array with a predetermined array or subset thereof, at step 32, reveals a match, then the group is a winner and each entrant is awarded a specified prize for each unit of his or her wager, as at 34. However, if no match is made, the group is a loser, as shown in step 36, and all wagers revert to the operator of the game.

Figure 4:
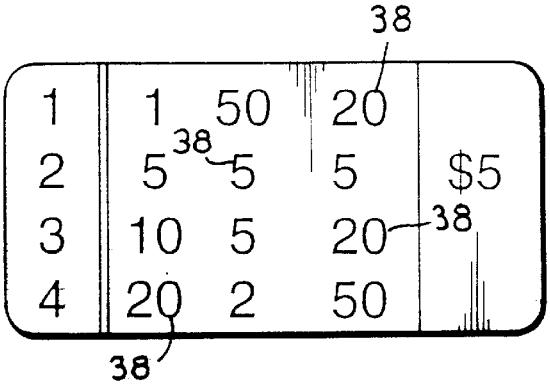
FIG. 4 is a plan view of a display indicating the outcome of a sample iteration of the group participation game.

An exemplary display of the outcome of a group participation game played in accordance with the preferred embodiment is shown in FIG. 4, and includes an array made up of a plurality of rows and columns in which the randomly generated indicia 38 are displayed. Along the left side of the array are numbers indicating the game or row numbers in the array, and along the right side of the array is a column in which the winnings, if any, are displayed.

The indicia 38 generated and displayed in the group game preferably represent multipliers of the wager made by each player, and the odds of a given multiplier correspond to the magnitude of the multiplier. For example, if the multipliers 1, 2, 5, 10, 20 and 50 represent the field from which the range of indicia generated are to be selected, the odds of generating a 1 are far greater than those of generating a 50. One method employed to accomplish this weighted drawing is to employ a large field of numbers, and to assign each multiplier to a predetermined range of numbers, wherein the range of numbers assigned to the larger multipliers is substantially smaller than the range assigned to smaller multipliers. For example, if a field of 1000 numbers is used to generate the 6 multipliers noted, a multiplier of 1 would be generated if any number between 1 and 500 is drawn. Likewise, a multiplier of 2 would be generated if any number between 501 and 750 is drawn, a multiplier of 5 would be generated if a number between 751 and 850 is drawn, a multiplier of 10 would be generated if a number of between 851 and 900 is drawn, etc.

The multipliers generated during the game are displayed at random locations within the array, as dictated by the central processing unit, and are displayed one-by-one within the array so that all entrants can monitor the progress of the game and anticipate whether the group will win or lose. In the illustrated embodiment, the group wins if the three multipliers in any given row of the array match one another, and the group loses if the multipliers in all of the rows of the array fail to include all matching multipliers. Thus, as shown in FIG. 4, by generating the multiplier 5 for all three columns of row 2 of the array, winnings of $5 are awarded to all entrants who wagered $1 on the group game. Because the indicia generated during the game is a multiplier of the amount wagered on the game, if an entrant wagered $5 on the group game, his or her winnings would be $25. Thus, although all of the entrants win or lose simultaneously during play of the game, individual entrants are awarded winnings based on the entry wagers made.

In accordance with another aspect of the preferred game, the indicia 38 generated during the game can be numbers, pictures, playing cards, dice or other indicia representative of actual dollar amounts to be paid to all entrants, or they can be symbols or other indicia that must be arranged in a predetermined array or order to represent a winner for the group. In any event, a characteristic feature of the group game is the simultaneous observation of the game by all entrants gathered at each display so that a group excitement of anticipation is generated that draws people to the game and keeps their attention.

When played in combination with an individual participation game such as keno, the group participation game resembles a bonus game in which all players, not just the winners of the keno game, are rewarded by the drawing of a winning combination of multipliers. As such, even if an individual loses his or her keno wager, they have the same chance as all other entrants in the group game to win that game.

Although the "bonus" nature of the game does not exist when it is offered independent of other games, it is possible to host the group game as a stand alone game. In order to play the game in this manner, a group is first formed at 40 of all individuals who enter the game by making a wager, a drawing is made at 28, and a determination is then made at 32, as to whether the group is a winner or loser. Thus, all entrants are able to simultaneously observe the game, and they win or lose as a group rather than as individuals. As with the combination game, none of the entrants is required or allowed to select indicia to play, but rather the entire group wins or loses with the same combinations, providing an environment in which every player is rooting for the same outcome as every other player.

Although the invention has been described with reference to the preferred embodiment illustrated in the attached drawing figures, it is noted that substitutions may be made and equivalents employed herein without departing from the scope of the invention as recited in the claims. For example, the group game can be employed in combination with games other than keno, such as bingo, a lottery, horse racing, dog racing, Jai Alai, table games, and gaming machines.

When the group game is combined with a bingo game, a separate blower is preferably provided along with predetermined quantities of bingo-type balls, wherein the numbers on the balls represent multipliers as described herein. A three-by-three array is displayed in which the randomly drawn balls are arranged, and the group of entrants in the game wins if the multipliers in any row, column or diagonal of the array match a predetermined winning combination. The group is formed of all entrants of the previous bingo game who made a wager on the outcome of the group game at the same time that they wagered on the bingo game.

When used in combination with a lottery game, the group game is conducted in conjunction with the lottery drawing in the same manner as it is conducted in combination with the keno game, with the group being formed of all entrants in the lottery who also made a wager on the outcome of the group game.

At the time an individual makes a wager on a dog race, horse race, Jai Alai game or other sporting event, they can also make a wager on a group game that is to be played during an intermission or between events. The group game is hosted as described herein, with multipliers or other indicia being generated and compared with a winning combination of indicia for a match. If such a match occurs, the group wins as a whole, and the amount of the winnings to each player are dictated by the amount of his or her wager.

As gaming machines grow in popularity, and improvements to such machines are made, it is possible to provide a group gaming experience to individual players of such machines by combining the machine play with the group game of the present invention. An example of such a combination would include interrupting regular play of the machines at regular intervals in order to host a group game. Preferably, the group would include all machines that had maintained a predetermined level of play for the previous time interval such that this continued play would represent the wager required to enter the machine in the group game. Alternately, each player could be given the choice to either continue individual play or participate in a group game, the group for the group game would be formed of all those who indicated a desire to wager on the group game. As with the keno game, individuals could be allowed to make an increased wager, and the reward would be a multiplier that would be applied to this wager in establishing an individual's winnings.

The particular game with which the group game is played can vary, as can the apparatus used to host the game and display the indicia being generated by the host. Such variations do not depart from the invention as claimed.

What is claimed is:

1. A method of playing a group participation wagering game having a minimum wager amount, said method comprising:

facilitating the forming of a group of a plurality of entrants, wherein each of said entrants participates in the group participation game irrespective of said entrant's participation in an individual participation game, wherein each of said entrants is an individual who has wagered at least said minimum wager amount, the amount each entrant wagered being made on a single outcome of a single group participation game, and wherein each outcome of said group participation game is independent of an outcome of the individual participation game; and determining the outcome of said single group participation game based on a single set of indicia common to the group, wherein all entrants in the group collectively win or collectively lose said single group participation game based on said single set of indicia.

2. The method as recited in claim 1 wherein none of said entrants are allowed or required to make an indicia selection prior to entering the group participation game.

3. The method as recited in claim 1 wherein each of said entrants that made an equivalent wager on an outcome of the group game is awarded an equivalent prize amount if said outcome is a winning outcome.

4. The method as recited in claim 1 wherein each of said entrants is guaranteed participation in the group game.

5. The method as recited in claim 2 wherein each of said entrants that made an equivalent wager on an outcome of the group game is awarded an equivalent prize amount if said outcome is a winning outcome.

6. The method as recited in claim 5 wherein each of said entrants is guaranteed participation in the group game.

7. The method as recited in claim 4 wherein none of said entrants are allowed or required to make an indicia selection prior to entering the group participation game.

8. The method as recited in claim 4 wherein each of said entrants that made an equivalent wager on the outcome of the group game is awarded an equivalent prize amount if said outcome is a winning outcome.

9. A method of playing a group participation wagering game having a minimum wager amount, said method comprising:

enabling entrants to participate in the group participation game irrespective of said entrants' participation in an individual participation game, wherein each of said entrants is an individual who has wagered at least said minimum wager amount, the amount each entrant wagered being made on a single outcome of a single group participation game, and wherein each outcome of said group participation game is independent of an outcome of the individual participation game; and determining the outcome of said single group participation game based on a single set of indicia common to the group wherein all entrants in the group collectively win or collectively lose said single group participation game based on said single set of indicia.

10. The method as recited in claim 9 wherein none of said entrants are allowed or required to make an indicia selection prior to entering the group participation game.

11. The method as recited in claim 9 wherein each of said entrants who made an equivalent wager on an outcome of the group game is awarded an equivalent prize amount if said outcome is a winning outcome.

12. The method as recited in claim 10 wherein each of said entrants who made an equivalent wager on an outcome of the group game is awarded an equivalent prize amount if said outcome is a winning outcome.

13. The method as recited in claim 12 wherein each of said entrants is guaranteed participation in the group game.

14. The method as recited in claim 9 wherein each of said entrants is guaranteed participation in the group game.

15. The method as recited in claim 10 wherein each of said entrants is guaranteed participation in the group game.

* * * * *